United States Patent [19]

Freeman

[11] 4,159,404

[45] Jun. 26, 1979

[54] MULTI-POLE HIGH-VOLTAGE CIRCUIT-INTERRUPTER HAVING INDEPENDENT POLE TRIPPING WITH A SINGLE COMMON OPERATING MECHANISM

[75] Inventor: Willie B. Freeman, Monroeville, Pa.

[73] Assignee: Westinghouse Electric Corp., Pittsburgh, Pa.

[21] Appl. No.: 646,797

[22] Filed: Jan. 6, 1976

[51] Int. Cl.[2] ..... H01H 33/14; H01H 9/20

[52] U.S. Cl. ..... 200/145; 200/148 R; 200/153 G

[58] Field of Search ..... 200/148 R, 153 G, 145

[56] References Cited

U.S. PATENT DOCUMENTS

| | | | |
|---|---|---|---|
| 3,335,367 | 8/1967 | Skooglund et al. | 324/97 |
| 3,457,530 | 7/1969 | Van Sickle | 200/148 R |
| 3,600,539 | 8/1971 | Walker et al. | 200/153 G |
| 3,600,541 | 8/1971 | Goodwin, Jr. | 200/153 G |
| 3,684,848 | 8/1972 | Davies | 200/153 G |
| 3,787,649 | 1/1974 | Goodwin, Jr. et al. | 200/153 H |
| 3,794,798 | 2/1974 | Trayer | 200/153 G |
| 3,872,273 | 3/1975 | Netzel | 200/153 G |

*Primary Examiner*—Robert S. Macon
*Attorney, Agent, or Firm*—L. P. Johns

[57] ABSTRACT

A multi-pole high-power circuit-interrupter is provided having a common operating mechanism, and having independent pole operation by associating with each of the several pole-units its own independent collapsible latching means, which may be very quickly released upon a tripping operation associated with the respective pole-unit to which said latch is individually connected.

Another important feature of the invention, is an overlapping toggle arrangement, in which the toggle is overlapped in the closed-circuit position of the circuit-interrupter, and may be very quickly released to an extended unlatched position, for example, by an electromagnetically-operated tripping device, such as a repulsion coil, for example.

14 Claims, 17 Drawing Figures

FIG. 1.
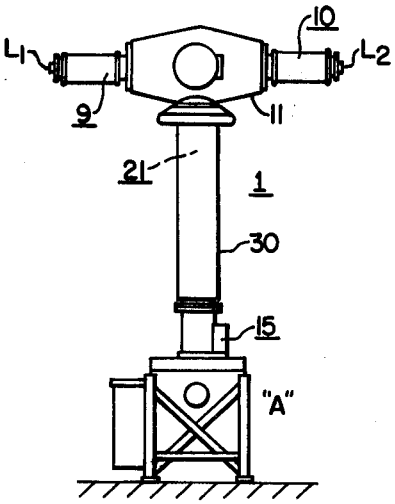
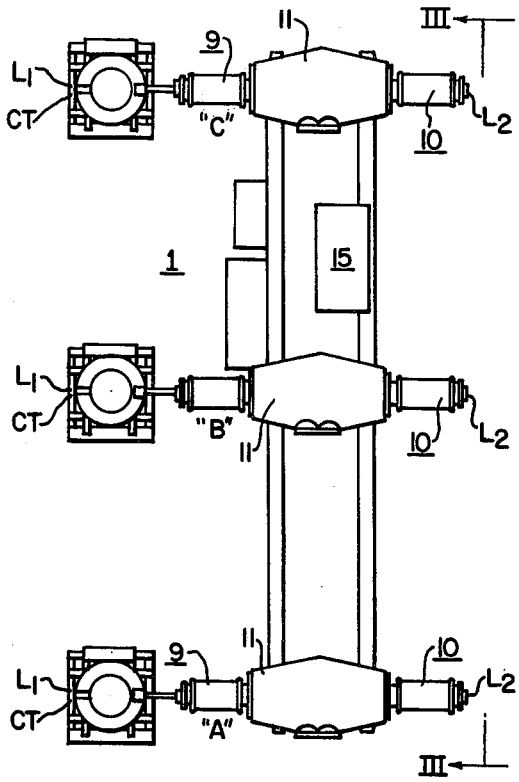
FIG. 2.
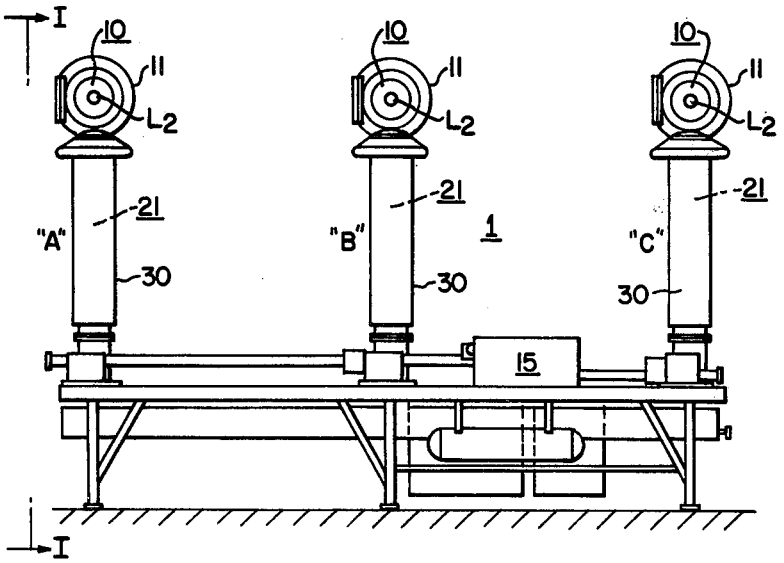
FIG. 3.

MULTI-POLE HIGH-VOLTAGE CIRCUIT-INTERRUPTER HAVING INDEPENDENT POLE TRIPPING WITH A SINGLE COMMON OPERATING MECHANISM

CROSS-REFERENCES TO RELATED APPLICATIONS

Applicant is not aware of any related patent application pertinent to the present invention.

SUMMARY OF THE INVENTION

In accordance with the present invention, a multipole high-voltage circuit-interrupter, utilized for interrupting multi-phase circuits, has a common operating mechanism for simultaneously opening and closing the contacts provided within the several pole-units. Associated with each of the several pole-units, and controlling its independent operation, is a releasable latching tripping structure, which enables the independent pole-tripping operation for each of the pole-units independently of the other pole-units, should a fault current pass through that particular pole-unit. This has the important desirable advantage that should the contacts of one of the pole-units remain welded closed, and thus unable to open, nevertheless the other two associated companion pole-units will, through the intermediary of their independent releasable tripping latching systems, open to thereby open the other two phases of the three-phase circuit, and thus interrupt the power flow through the three-phase transimission system.

Another feature of the present invention is the utilization of an overalpping toggle-linkage arrangement, in which the toggle structure is overlapped in the closed-circuit latched position of the circuit-interrupter, and is releasably tripped to an extended non-overalpped released condition following the energization of a tripping means, such as an electrically-actuated repulsion coil, for example.

Still another feature of the present invention is the provision of an independently-pole-operated latching system associated with the high-voltage interrupting head of a high-voltage circuit-interrupter, disposed at a considerable distance up in the air above ground potential, and enabling the indpendent selective tripping operation of that particular faulted pole-unit independently of the other assoicated adjacent companion pole-units.

BRIEF DESCRIPITION OF THE DRAWINGS

FIG. 1 is a side-elevational view of an end pole-unit of a three-phase circuit-interrupting structure;

FIG. 2 is a top plan view looking downwardly upon the three pole-units of the three-phase interrupting assemblage of FIG. 1;

FIG. 3 is a side-elevational view of the three pole-units of the three-phase interrupting assemblage, indicating the location and disposition of the toggle-overlapping latching means constituting a part of the instant invention;

Figure 17:
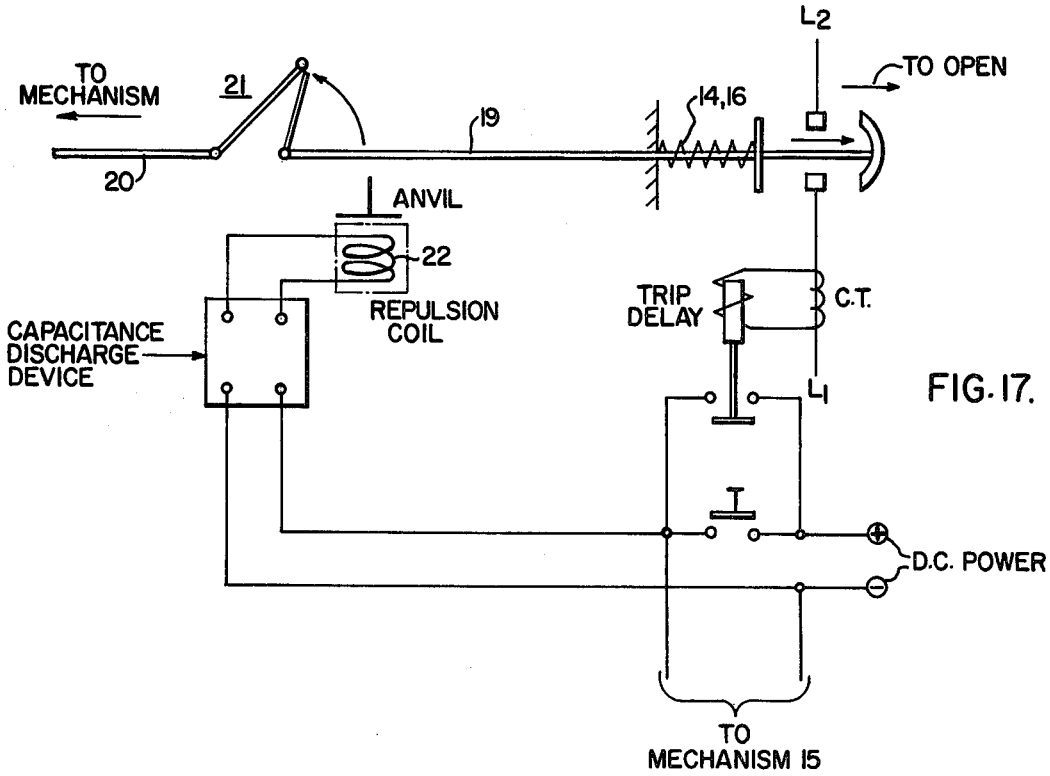
Figure 11:
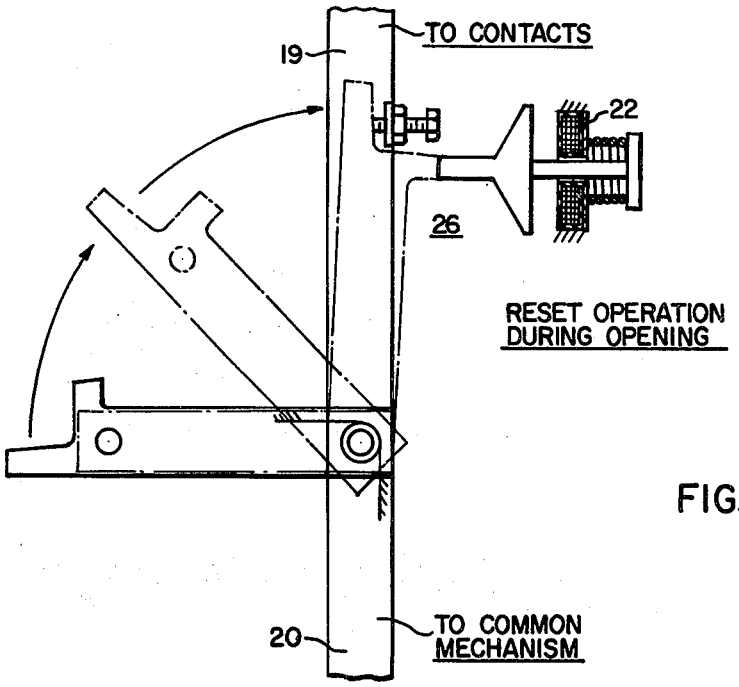
Figure 12:
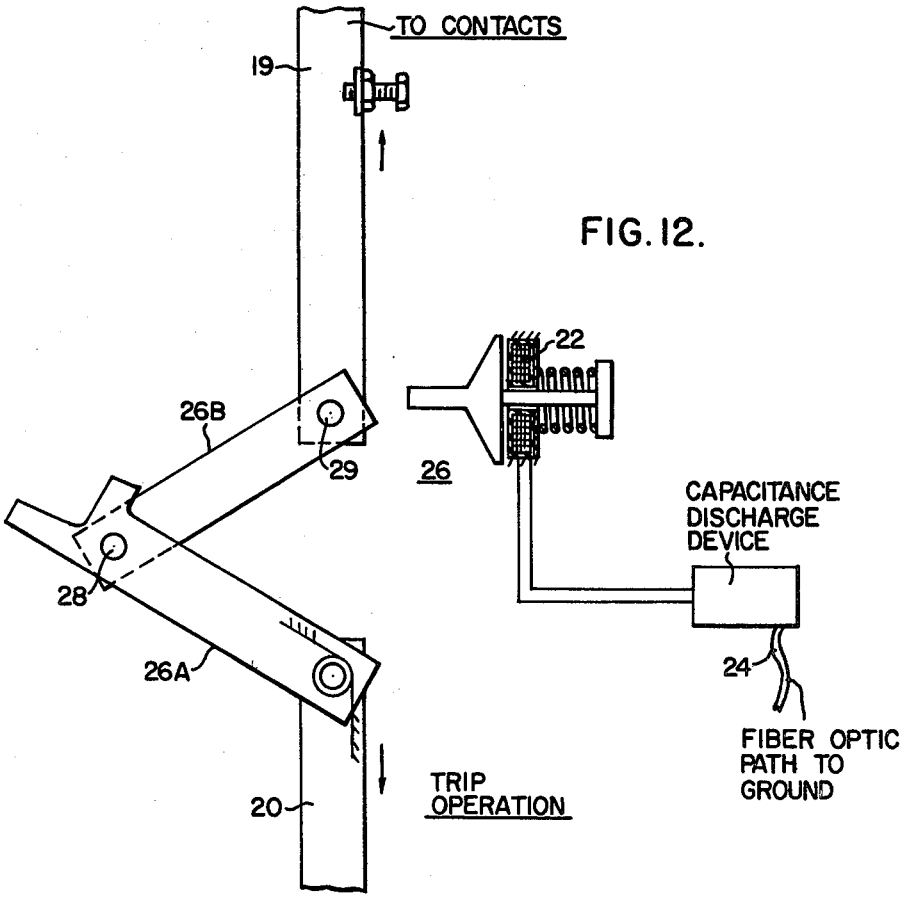
Figure 13:
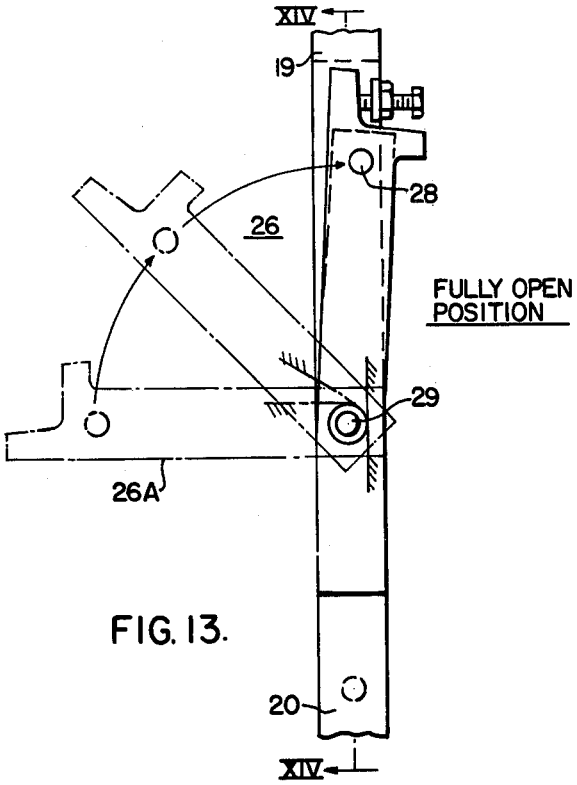
Figure 14:
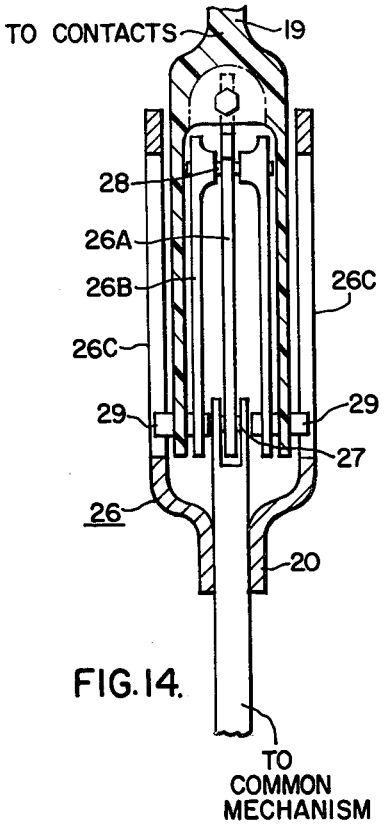
Figure 16:
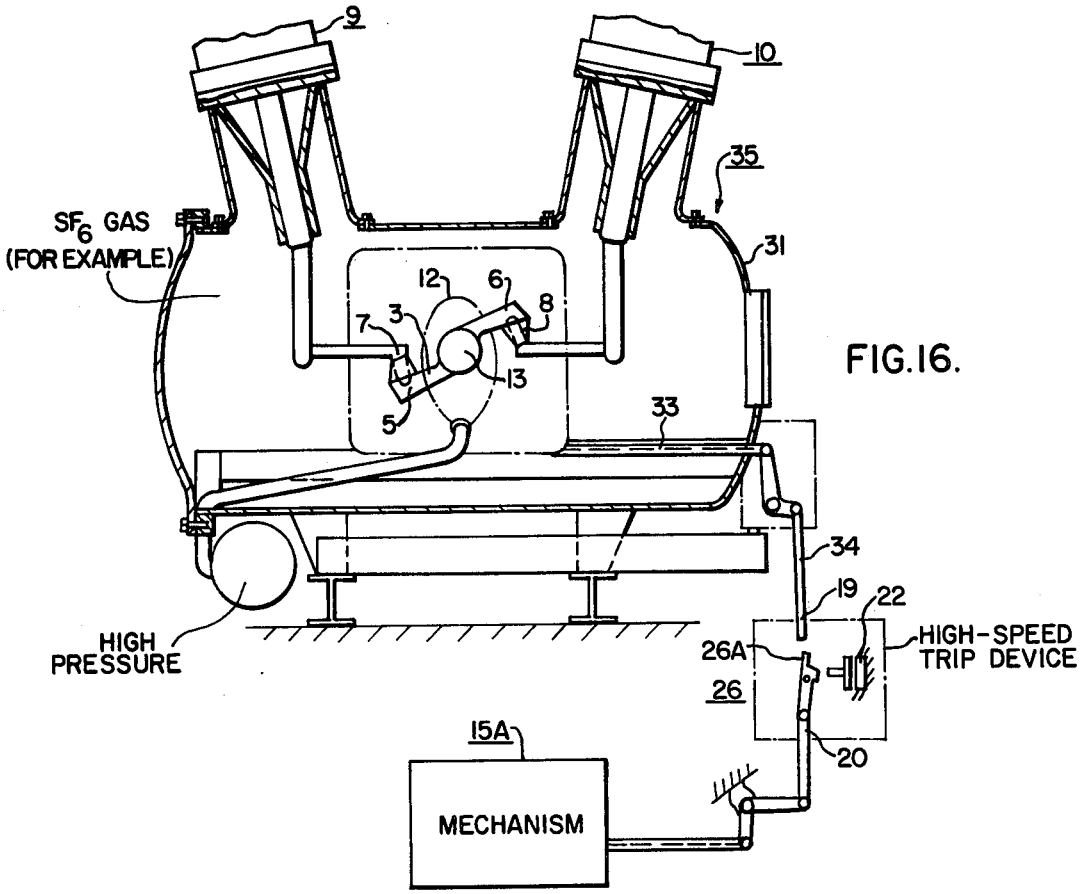
Figure 15:
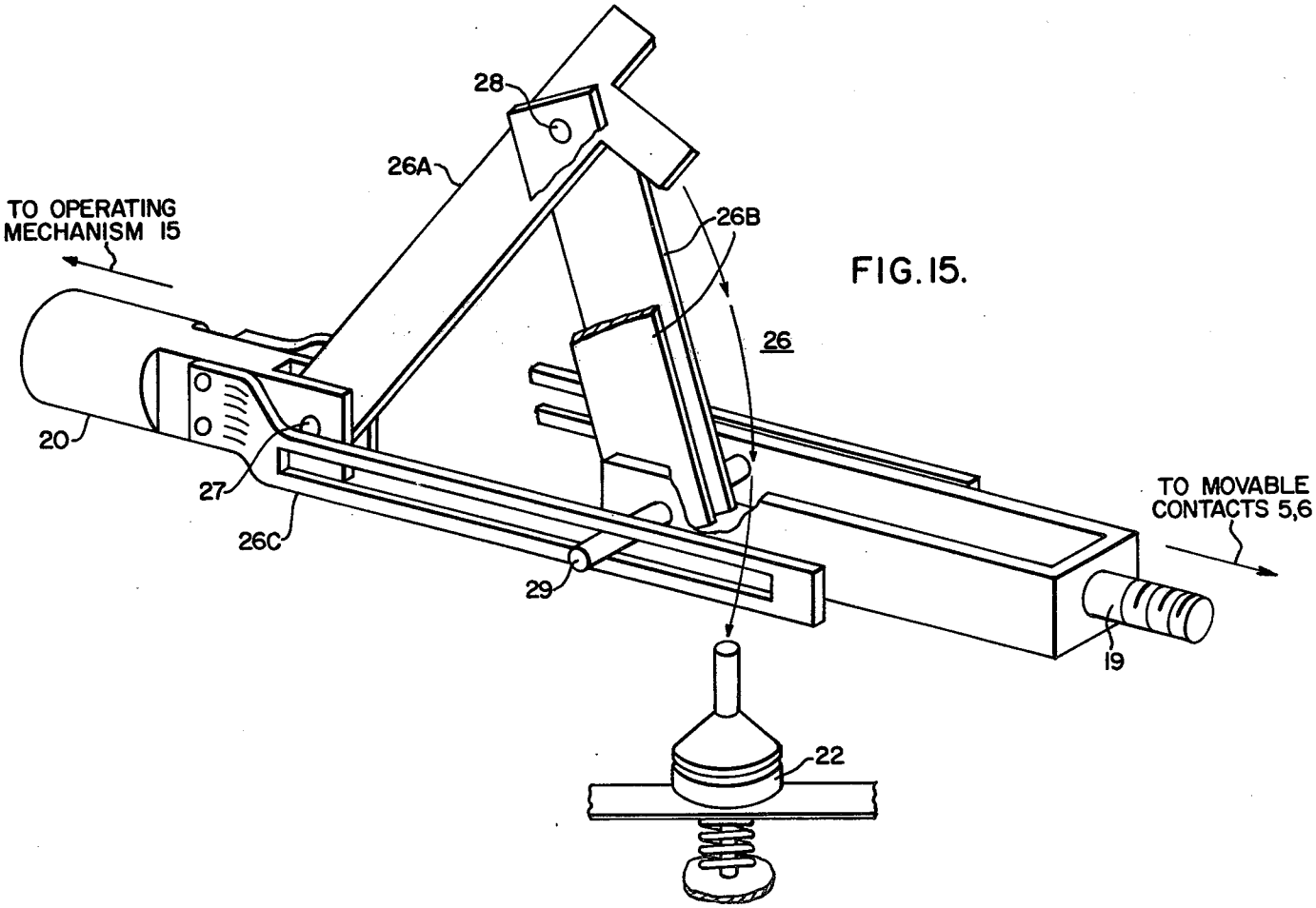

FIGS. 11, 12 and 13 illustrate a modified-type of overlapping toggle latching arrangement, in which the pivot pins are preferably on a coincident center, with FIG. 11 illustrating the tripping operation, with the toggle unlatched, FIG. 12 illustrating a trip operation indicating the linkage travel, and FIG. 13 illustrating a trip operation with the toggle being reset at the end of the opening operation of the circuit-interrupter;

FIG. 14 is a side view of the toggle latching structure of FIG. 13;

FIG. 15 is a perspective view of the toggleoperating latching arrangement of FIGS. 11–14;

FIG. 16 is a vertical section view taken through a modified-type of dead tank type of circuit interrupter construction, in which the rotating movable contacts are close to ground potential, and the length of the operating control-rods being shortened to obtain fast breaker-opening operation; and, FIG. 17 is a diagrammatic view of the wiring diagram for controlling a single-phase pole-unit of the circuit interrupting structure of FIGS. 1–3.

DESCRIPTION OF THE PREFERRED EMBODIMENTS

Referring to the drawings, and more particularly to FIGS. 1–7 thereof, it will be observed that there is provided a high-voltage three-phase compressed-gas circuit-interrupter 1 of the type set forth in U.S. Pat. No. 3,457,530, issued July 22, 1969 to R. C. Van Sickle, and assigned to the assignee of the instant application. Generally, the contact construction of the high-voltage interrupter of FIGS. 1–3 is set forth in FIG. 4, which shows the rotating movable contact-arm construction 3, in which a pair of serially-related movable contacts 5, 6 are separable from a pair of spaced relatively-stationary contacts 7, 8, the latter being connected to the inner ends of a pair of terminal-bushings 9, 10, extending laterally outwardly through a metallic interrupter casing 11. During the opening operation, and as set forth in said U.S. Pat. No. 3,457,530, the two movable contacts 5, 6 separate from the two relatively-stationary contacts 7, 8, drawing two arcs (not shown) in series, and establishing a gas-flow from a high-pressure gas-reservoir chamber 12, extending along the axis 13 of the movable rotatable contact assembly 3. Reference may again be made to said U.S. Pat. No. 3,457,530 for a detailed description.

Figure 4:
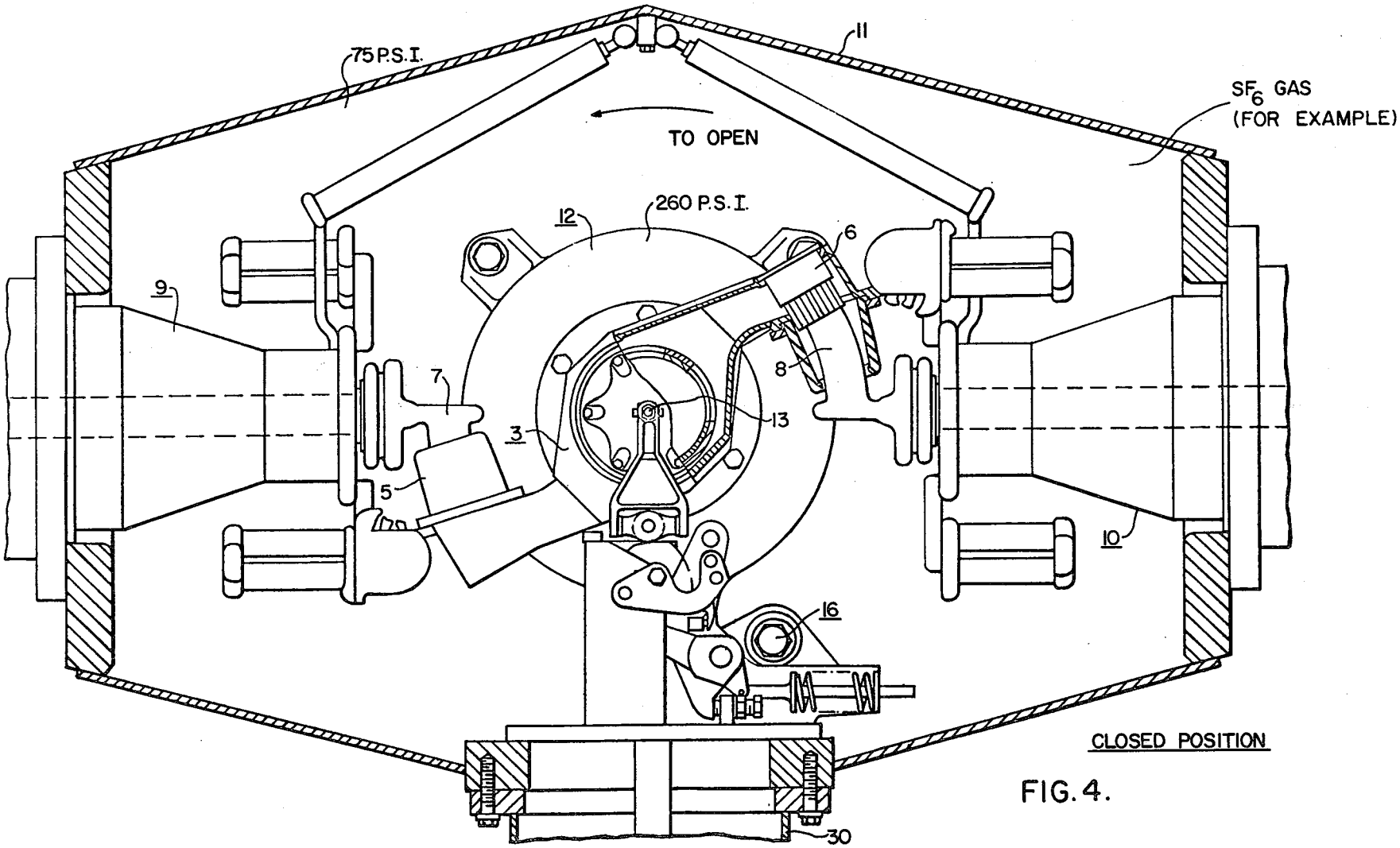
FIG. 4 is a considerably-enlarged view taken through one of the interrupting heads, indicating the contact structure therein in the closed-circuit position.
Figure 5:
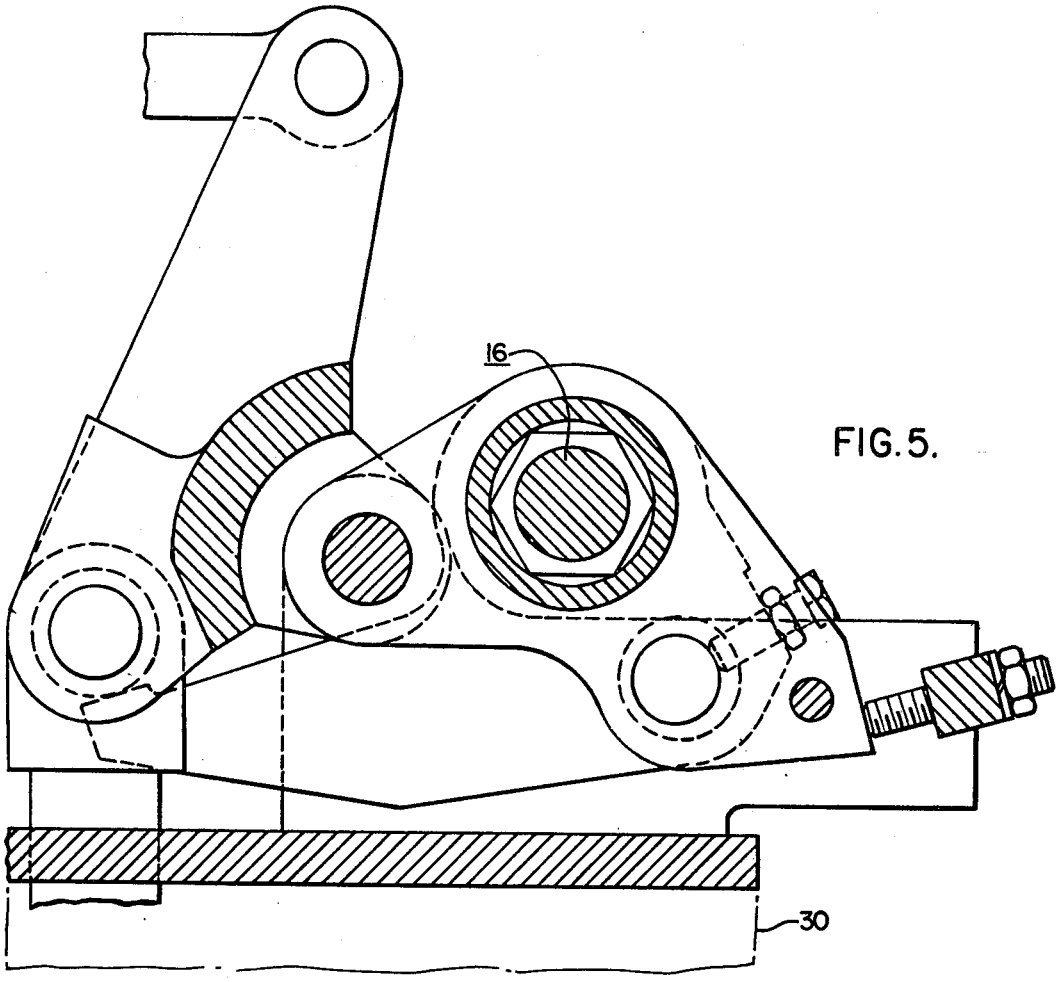
FIG. 5 is a detailed view of the operating crankarm assemblage utilized within the interior of the interrupting head illustrated in FIG. 4 for operating the contacts.
Figure 6:
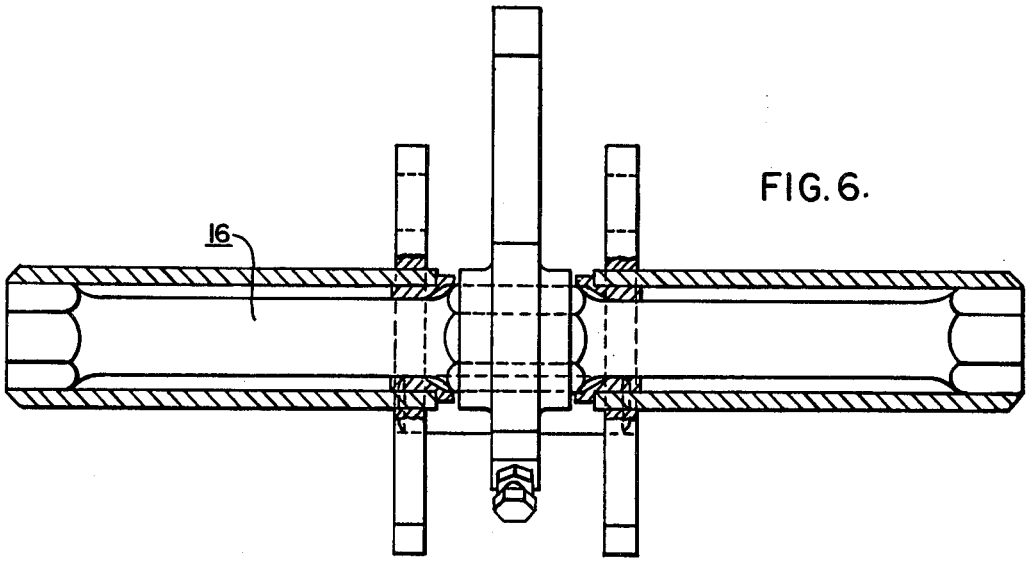
FIG. 6 is a view taken substantially along the line VI—VI of FIG. 5, idnicating the accelerating compression-spring means and the torsion-bar construction.
Figure 7:
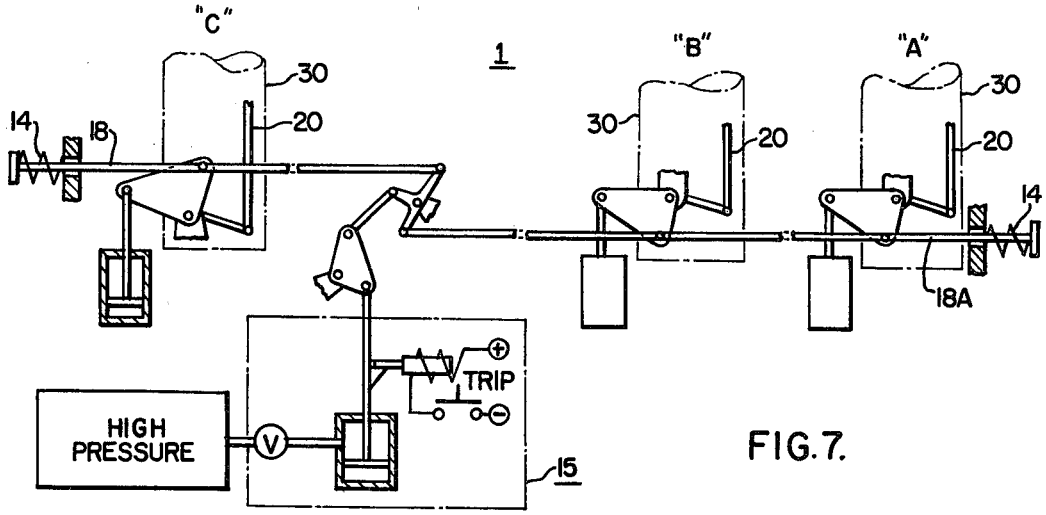
FIG. 7 is a diagrammatic view indicating the common operating mechanism at ground potential for all the three pole-units, diagrammatically indicating the upwardly-extending longitudinal insulating operating-rods associated with each of the three pole-units.

It will be observed, with reference to FIGS. 4–6, that in the closed-circuit position of the separable contact structure of FIG. 4, that the movable contacts 5, 6 are under considerable accelerating spring pressure tending to strongly effect their opening motion. This is not only provided by a pair of "tail" springs 14 (FIG. 7), associated with the ground-operating mechanism 15, but, importantly, a heavy torsion-bar 16, as set forth more clearly in FIG. 6, is provided to enable a tremendous opening accelerating "kickoff" spring action at the contact structure itself enabling thereby a very fast initial opening operation of the contacts to be achieved, which, subsequently, is carried out by the aforementioned "tail" springs 14, disposed at the outer ends of the ground-operating rods 18, 18A (FIG. 7) disposed at ground potential.

Figure 10:
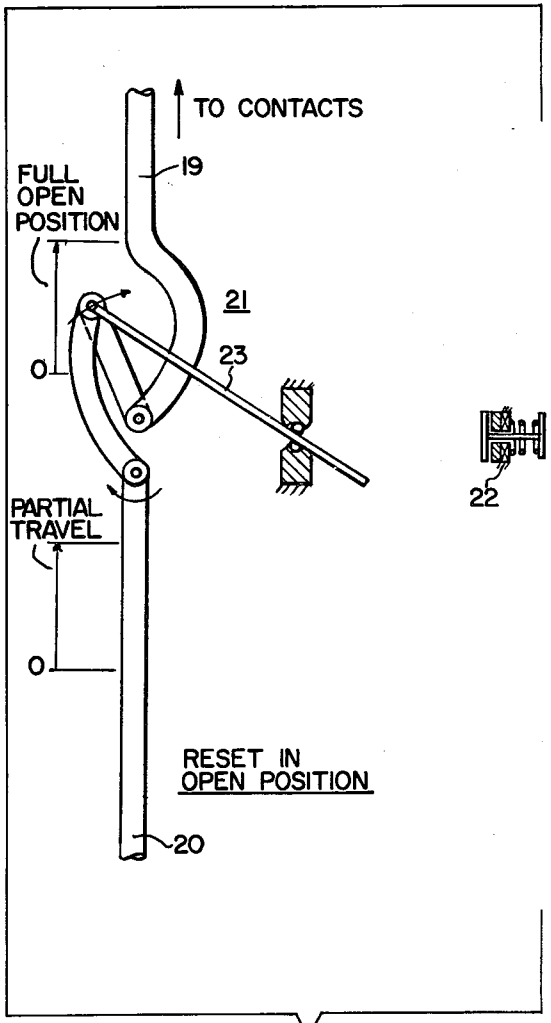
FIG. 10 is a view similar to FIGS. 8 and 9, but indicating a resetting of the overlapping toggle latching arrangement at the end of the opening operation.
Figure 9:
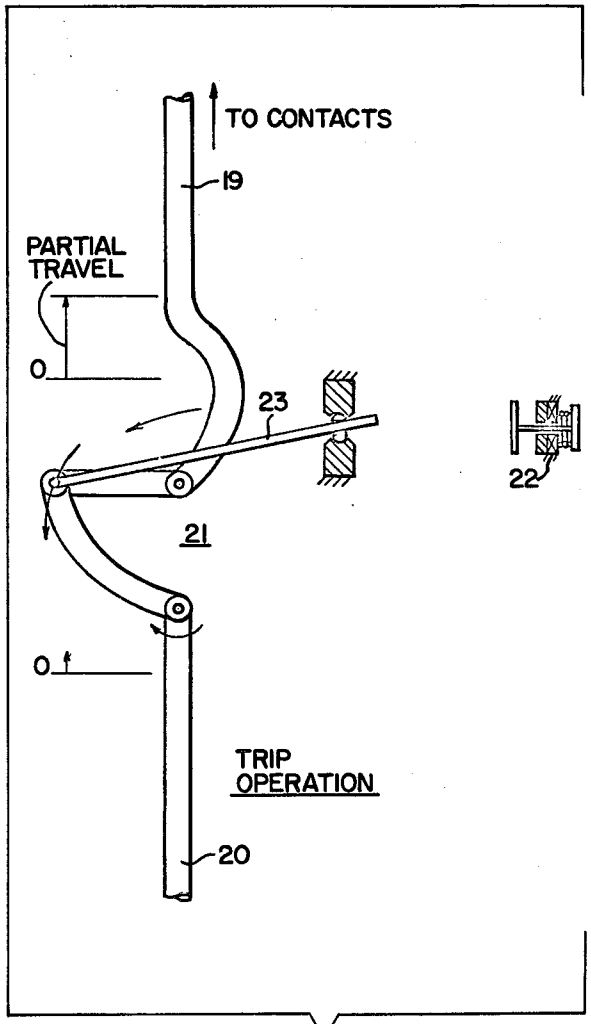
FIG. 9 is a view similar to that of FIG. 8, but illustrating the disposition of the toggle latching linkage parts during a tripping operation.
Figure 8:
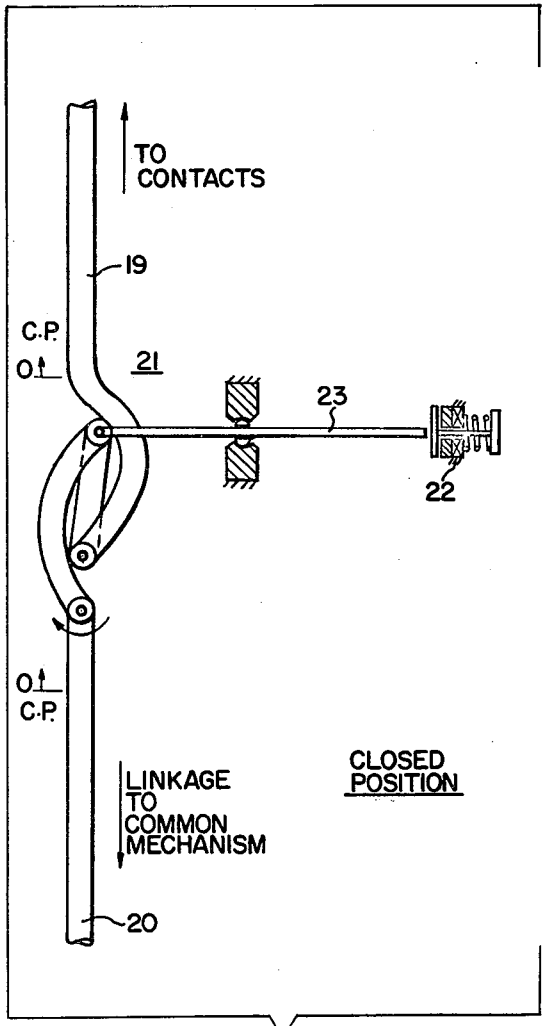
FIG. 8 illustrates the overlapping toggle latching arrangement of the present invention with the contacts closed, and the tripping repulsion coil deenergized.

To provide independent pole operation for each of the three pole-units "A", "B" and "C", there is associated with the upper extremity of each of the upwardly-extending three insulating operating rods 20 an overlapping latching toggle-linkage, generally designated by the reference numeral 21, and shown more clearly in FIGS. 8–10 of the drawings. FIG. 3 shows the general location of the latching structures 21.

FIG. 8 illustrates more clearly the overlapping toggle latching construction 21 of the expensible latching linkage in the closed-circuit position of the circuit-interrupter 1. FIG. 9 illustrates the beginning of a trip operation, in which a repulsion coil 22 effects leftward impact tripping operation of a trip-rod 23, rendering thereby an extension of the toggle latching linkage 21. FIG. 10 illustrates the subsequent resetting of the toggle-linkage 21 during the final portion of the opening operation of the breaker 1.

It will be observed that one important advantage results by the independent pole operation, in that each of the interrupters "A", "B" and "C" has its own individual particular latching mechanism 21, which is independently operated from the other companion pole-units. In other words, each of the pole-units "A", "B" and "C" has its own individual tripping repulsion coil 22, which independently operates the toggle-linkage 21 associated with that particular pole-unit, and not being dependent on the other two toggle-linkages 21 associated with the other two companion pole-units.

The repulsion coil 22, which is set forth herein by way of example only, may be actuated from ground potential, for example, by a fiber-optical path 24 (FIG. 12), which extends, in an insulating fashion, down to ground potential, and may be energized by any suitable means. U.S. Pat. No. 3,335,367 issued Aug. 8, 1967 to Skooglund et al may be referred to in this connection.

FIGS. 11–15 illustrate a modified-type of overlapping toggle latching linkage 26, in which again a toggle-link 26A is associated with the common operating mechanism 15, whereas the cooperating toggle-link 26B is associated with the movable contact structure 5, 7 and 6, 8. As before, there is an overlapping toggle construction 26 with the pivot connection 27, 28, 29 of the mechanism-links 26A, 26B being coincident on the same pivot axis 27, as the pivot point for the other toggle-links, as shown more clearly in FIG. 15 of the drawings.

With reference to FIG. 11, it will be observed that the figure illustrates the tripping operation, with the toggle 26 being unlatched, but yet the upper toggle-link 26B, connected to the breaker contacts, remaining in its latched position. FIG. 12 illustrates a further state of affairs, wherein the upper toggle-link 26B, connected to the breaker contacts, being released and moving upwardly to effect thereby a fast tripping operation of the breaker contacts 5, 7 and 6, 8.

FIG. 13 illustrates the end of the tripping operation with the toggle-linkage 26 being reset. This occurs at the end of the opening operation of the circuit breaker 1, in which the lower toggle-like 26A, connected to the common operating mechanism 15, moves upwardly to effect thereby a relatching of the entire toggle-linkage 26.

FIG. 14 illustrates the bifurcated construction of the overlapping toggle-linkage 26 with more clarity, it being observed that the bifurcated end of the breaker-rod 19 is disposed such that the two links 26A and 26B associated with the operating-mechanism toggle-link are nested within.

FIG. 15 illustrates a perspective view showing with still more clarity the overlapping toggle-linkage arrangement 26, and illustrates a condition similar to that of FIG. 12, in which the contacts 5, 6 are open, the latching toggle 26 being extended, yet nevertheless the lower pivot 27 being in its initial closed-breaker position, as shown in FIG. 8. This indicates the tremendous rapidity of operation and releasing action, independent of the mass of the lower linkage 18, 18A, which is possible by the overlapping toggle-link latching construction.

The outer arms 26C, illustrated in FIGS. 14 and 15, are slotted, as at 32, to act as a guide rail for the movable pivot pin 29, and thus maintain the alignment of the rods 19 and 20.

With reference to FIG. 16, it will be observed that instead of putting the breaker-interrupting head 11 up in the air upon upstanding insulating columns 30, instead this figure shows a modified construction of a horizontal dead-tank, three-phase, 31, in which the rotating contact-arms 5, 6 are close to ground potential. Again, for the three-pole construction, there is provided only a single common operating mechanism 15A, which, as before, may follow the teachings of U.S. Pat. No. 3,457,530.

The advantage of the modified construction, set forth in FIG. 16, and particularly adaptable for 362 kV construction, is that a much shorter length of the operating-rods 33, 34 is required, and thereby quick single-cycle opening operation of the circuit-interrupter 35 is achieved. As before, the toggle-linkage involves an overlapping toggle construction 26, which is independently released for each of the several pole-units "A", "B" and "C".

Although there have been illustrated and described specific interrupting structures, it is to be clearly understood that the same were merely for the purpose of illustration, and that changes and modifications may readily be made therein by those skilled in the art, without departing from the spirit and scope of the invention.

What I claim is:

1. The combination in a multi-pole high-power high-voltage circuit interrupter assemblage having a plurality of pole-units adaptable for interrupting multi-phase circuits, of a common operating mechanism for simultaneously effecting the opening and closing operations of the several pole-units of said multiphase circuit-interrupter assemblage, independently-operated releasable latching linkage means associated with at least one of the pole-units and responsive to the current condition carried by said one pole-unit to effect its independent opening tripping operation independently of the other companion pole-units of the multi-phase interrupting assemblage upon excessive current flow therethrough.

2. The combination of claim 1, wherein the releasable latching means associated with said one pole-unit comprises an overlapping toggle construction.

3. The combination of claim 2, wherein the overlapping toggle construction comprises a pair of expansible toggle-links and associated knee-pins which toggle-links are in the overcenter position in the closed-circuit position of the respective one pole-unit.

4. The combination according to claim 2, wherein a tripping rod is associated with the knee-pin of the overlapping toggle-construction, and means are provided responsive to excessive current flow to impact said tripping rod.

5. The combination according to claim 2, wherein integral guide arms provide an alignment means of said overlapping toggle construction.

6. The combination of claim 2, wherein electromagnetically-operated impact means are provided to effect an impulse tripping thrust of the tripping rod connected to the knee-pin of the toggle-linkage.

7. In an extra-high-voltage circuit-interrupter of the multi-phase type, the combination of an interrupter head disposed at a considerable distance above ground potential, one or more series breaks disposed within said interrupter head, and an independent pole-operated releasable latching construction for permitting extension of an operating-rod associated with said respective pole-unit independently actuated from the common operating mechanism at ground potential.

8. The combination according to claim 7, wherein the releasable latching construction comprises an overlapping toggle-linkage structure, and a trip-rod is associated with the knee-pin of said overlapping toggle structure.

9. In combination, a multi-phase high-voltage high-power circuit-interrupter utilizing a plurality of interrupting assemblages disposed at a considerable distance above ground potential, and independent releasable latching arrangement for the operating rod of each of said pole-units, impact-providing electromagnetically-operated releasing means for effecting the release of each of said latching structures, means biasing the contacts of the respective interrupting assemblage to the open-circuit position, and insulating means transmitting intelligence from ground potential to said electromagnetically-operated releasing means.

10. In combination, a multi-phase high-power compressed-gas circuit-interrupter of the multi-pole type including a plurality of interrupting heads each being disposed at the upper end of an upstanding insulating column structure, a linearly-operating rod extending upwardly through the hollow column structure for actuating the contact structure within the respective interrupting assemblage, a common operating mechanism at ground potential for simultaneously effecting the opening and closing operations of the several operating rods extending upwardly within the several hollow insulating columns, each of said operating rods having associated therewith a releasable linkage adaptable for rapid extension of said operating rod independently of the operation of said common operating mechanism at ground potential.

11. The combination according to claim 10, wherein the releasable means comprises an overlapping toggle-linkage.

12. The combination according to claim 10, wherein the releasing means is disposed at the upper end of the respective hollow insulating column and close to the high-voltage separable contact structure.

13. In combination, a generally-horizontally-extending grounded metallic tank, two terminal-bushings extending downwardly into said tank, a rotatable movable contact assemblage disposed within said tank and cooperable with a pair of relatively stationary contacts therein, each of said stationary contacts being electrically connected to the interior end of one of said two downwardly extending terminal-bushings, a generally-horizontally-extending operating rod, and releasable linkage means for said tank permitting an extension thereof independently of the operation of the associated common operating mechanism.

14. The combination according to claim 13, wherein a plurality of said grounded metallic tanks are provided, each of said tanks enclosing a pole-unit adaptable for the interruption of one of the phases of a three-phase transmission line, each of the operating rods associated with each tank having an independent releasable latching construction, whereby independent pole-release is achieved by each of the individual pole-units.

* * * * *